US010861355B1

(12) United States Patent
Carley et al.

(10) Patent No.: US 10,861,355 B1
(45) Date of Patent: Dec. 8, 2020

(54) RACK DISPLAY

(71) Applicant: Oak Enterprises, LLC, Oklahoma City, OK (US)

(72) Inventors: Becky Carley, Edmond, OK (US); Kipp Collins, Oklahoma City, OK (US); Reed Reutlinger, Edmond, OK (US); Emily Wakim, Oklahoma City, OK (US)

(73) Assignee: Oak Enterprises, LLC, Oklahoma City, OK (US)

( * ) Notice: Subject to any disclaimer, the term of this patent is extended or adjusted under 35 U.S.C. 154(b) by 0 days.

(21) Appl. No.: 16/816,210

(22) Filed: Mar. 11, 2020

(51) Int. Cl.

| | |
|---|---|
| ***G09F 7/08*** | (2006.01) |
| ***A47F 5/00*** | (2006.01) |
| ***G09F 7/18*** | (2006.01) |
| ***G09F 3/20*** | (2006.01) |

(52) U.S. Cl.
CPC ..... *G09F 7/08* (2013.01); *A47F 5/0018* (2013.01); *A47F 5/0043* (2013.01); *G09F 3/204* (2013.01); *G09F 7/18* (2013.01); *G09F 2007/1843* (2013.01); *G09F 2007/1856* (2013.01)

(58) Field of Classification Search
CPC ..... G09F 7/08; G09F 7/18; G09F 2007/1843; G09F 2007/1856; G09F 3/204; A47F 5/0018; A47F 5/0043
See application file for complete search history.

(56) References Cited

U.S. PATENT DOCUMENTS

| | | | | |
|---|---|---|---|---|
| 4,187,630 | A * | 2/1980 | Giulie | A47G 1/0611 40/757 |
| 4,334,372 | A * | 6/1982 | Colmar | G09F 3/20 40/5 |
| 4,698,928 | A * | 10/1987 | Soporowski | G09F 7/08 40/605 |
| 5,346,076 | A * | 9/1994 | Hart | A47F 7/0021 211/49.1 |
| 5,437,116 | A * | 8/1995 | Hardy | F16B 12/26 211/189 |
| 5,465,516 | A * | 11/1995 | Stabile | G09F 3/204 248/220.22 |
| 5,624,044 | A * | 4/1997 | Black, Jr. | G09F 7/18 211/186 |
| 6,665,969 | B1 * | 12/2003 | Conway | G09F 3/204 40/605 |
| 7,048,131 | B2 * | 5/2006 | Gay | A47B 57/045 108/108 |
| 2002/0026737 | A1 * | 3/2002 | Tramont | G09F 7/08 40/606.19 |

(Continued)

*Primary Examiner* — Gary C Hoge
(74) *Attorney, Agent, or Firm* — Sean O'Connell, PLLC

(57) ABSTRACT

A product display system for use with sales of consumer products. The display includes a rack with at least one shelf to display screening products and a cross member for supporting a display assembly. The display assembly has a support channel with a bracket attached to the cross member. The display assembly also includes a housing sized to be received in the support channel. The display housing includes a base with a rear wall and upper and lower channel guides. The channel guides define opposing sets of channels for receiving a graphic insert with printed information and a transparent acrylic insert. The transparent insert has printed on it screen designs to allow viewing of the printed information through screen product designs displayed on the product display system.

11 Claims, 4 Drawing Sheets

(56) References Cited

U.S. PATENT DOCUMENTS

| | | | | |
|---|---|---|---|---|
| 2004/0262470 | A1* | 12/2004 | Lowry | G03B 21/00 248/205.1 |
| 2012/0193311 | A1* | 8/2012 | Benasillo | G09F 7/18 211/59.2 |
| 2018/0180261 | A1* | 6/2018 | Xue | A47F 3/001 |

* cited by examiner

RACK DISPLAY

FIELD OF THE INVENTION

The disclosed system relates to display systems for consumer products.

SUMMARY OF THE INVENTION

The present invention is directed to a display assembly comprising an elongate support channel, at least one mount bracket, and a display housing. The support channel has a back plate, a top rail extending from a top of the back plate, and a bottom rail extending from a bottom of the back plate. The mount bracket is secured to a back side of the channel back plate. The display housing comprises an elongate base, a graphic insert, and a transparent insert. The elongate base has a rear base wall, an upper channel guide extending from an upper edge of the base wall, and a lower channel guide extending from a lower edge of the base wall. The upper channel guide defines a first upper channel proximate the base wall and a second upper channel separated a predetermined distance from the first upper channel, each of the first and second upper channels spanning a length of the upper channel guide. The lower channel guide defines a first lower channel proximate the base wall and a second lower channel separated the predetermined distance from the lower channel, each of the first and second lower channels spanning a length of the lower channel guide. The first upper channel opposes the first lower channel and the second upper channel opposes the second lower channel. The graphic insert is adapted to be disposed in the first upper channel and the first lower channel. The transparent insert is adapted to be disposed in the second upper channel and the second lower channel. The display housing is adapted to be received by the support channel such that a back side of the base wall abuts a front side of the back.

In an alternative embodiment, the present invention is directed to a display system comprising a display rack and a display assembly. The display rack comprises a plurality of upright supports, at least one cross member connected between at least two of the plurality of upright supports, and at least one product shelf connected to the plurality of upright supports, where the product shelf is adapted to support at least one product for display. The display assembly comprises an elongate support channel, at least one mount bracket, and a display housing. The support channel has a rear channel wall, a top rail extending from a top of the back wall, and a bottom rail extending from a bottom of the wall. The mount bracket is secured to a back side of the channel wall and is adapted to be secured to at least one cross member of the rack. The display housing comprises an elongate base, a graphic insert, and a transparent insert. The elongate base has a rear base wall, an upper channel guide extending from an upper edge of the base wall, and a lower channel guide extending from a lower edge of the base wall. The upper channel guide defines a first upper channel proximate the base wall and a second upper channel separated a predetermined distance from the first upper channel, each of the first and second upper channels spanning a length of the upper channel guide. The lower channel guide defines a first lower channel proximate the base wall and a second lower channel separated the predetermined distance from the lower channel, each of the first and second lower channels spanning a length of the lower channel guide. The first upper channel opposes the first lower channel and the second upper channel opposes the second lower channel. The graphic insert is adapted to be disposed in the first upper channel and the first lower channel. The transparent insert is adapted to be disposed in the second upper channel and the second lower channel. The display housing is adapted to be received by the support channel such that a back side of the base wall abuts a front side of the channel wall.

DETAILED DESCRIPTION

Figure 1:
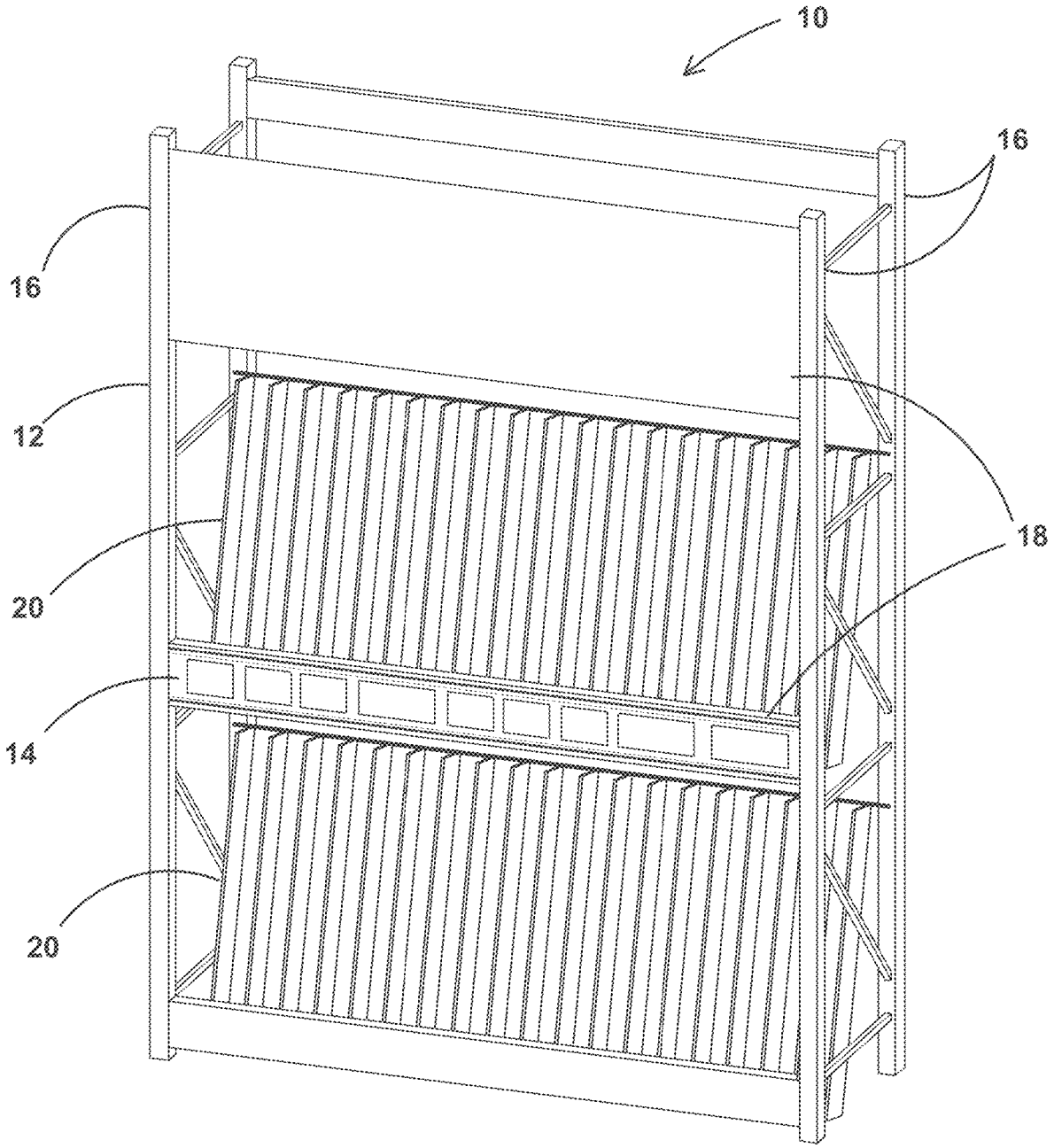
FIG. 1 is an isometric view of a rack display built in accordance with the present invention.

The disclosed system provides for a display system for use with consumer products. With reference now to the drawings and to FIG. 1 in particular, there is shown therein a display system, designated by reference numeral 10, in accordance with the present invention. The display system 10 shown is a free-standing unit, though the display system may also be integral with other structures. The display system 10 comprises a rack 12 and a merchandising display 14. Preferably the rack 12 comprises a plurality of upright supports or legs 16, a plurality of cross members 18, and one or more bays or shelves 20 for storage or retention of consumer items (not shown). As shown, the bays 20 may be structured to hold or support elongate items such as rolls of screen material.

Figures 2A, 2B:
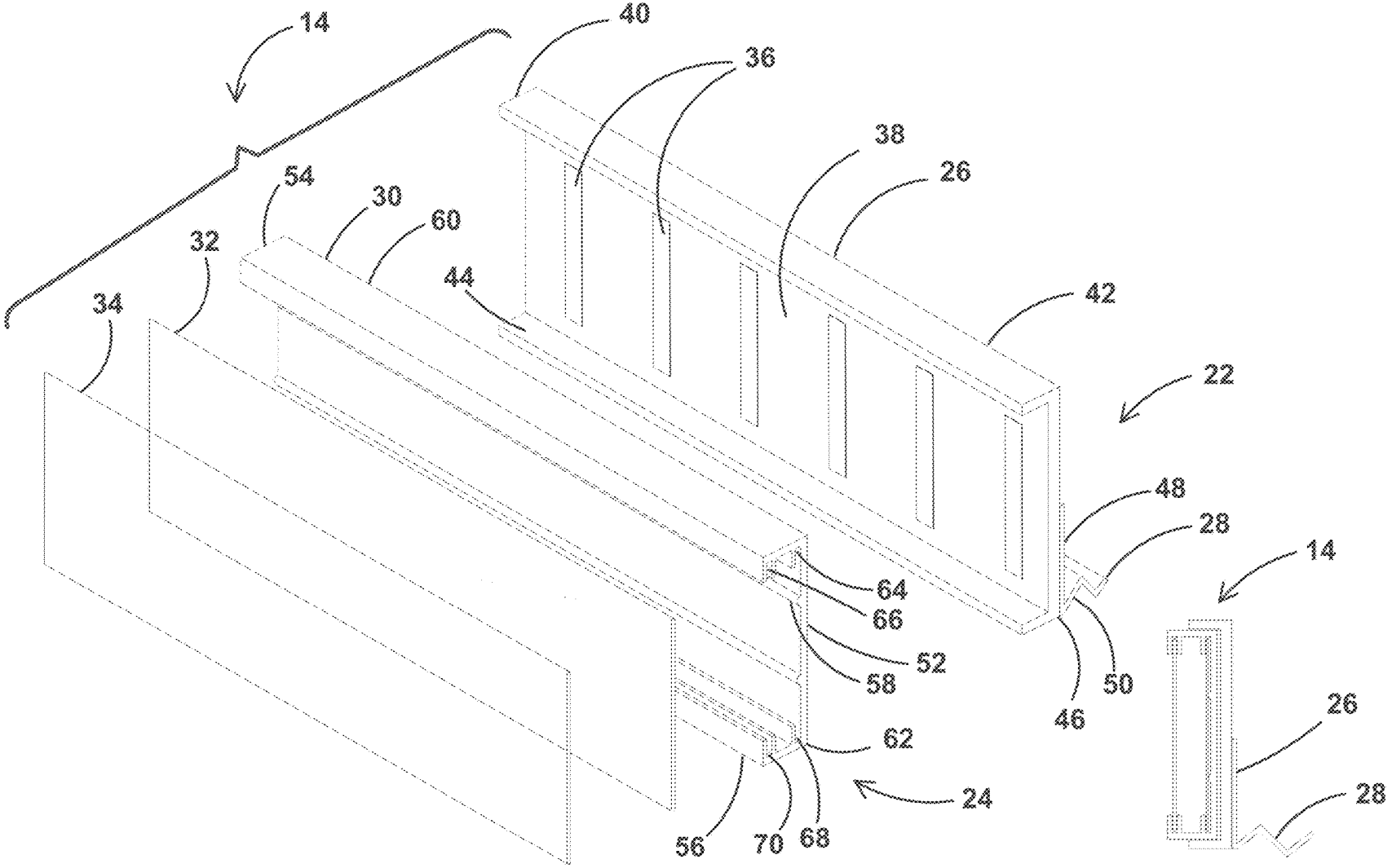
FIG. 2A is an isometric view of a support channel and mounting bracket for use with the rack display of FIG. 1.
FIG. 2B is an end view of the assembly shown in FIG. 2A.

With reference to FIG. 2, the merchandising display 14 is shown in an exploded view in FIG. 2A and in an end view elevation in FIG. 2B. The merchandising display 14 comprises a channel assembly 22 and a display assembly 24. The channel assembly 22 comprises an elongate support channel 26 and a mount bracket 28. The display assembly 24 comprises a display housing 30, a graphic insert 32, and a transparent insert 34. The display assembly 24 is adapted to be received in the support channel 26. Preferably, the display assembly 24 is secured to the support channel 26 using an adhesive 36. More preferably, the adhesive 36 may comprise a plurality of pieces of 2-sided tape.

Figure 3:
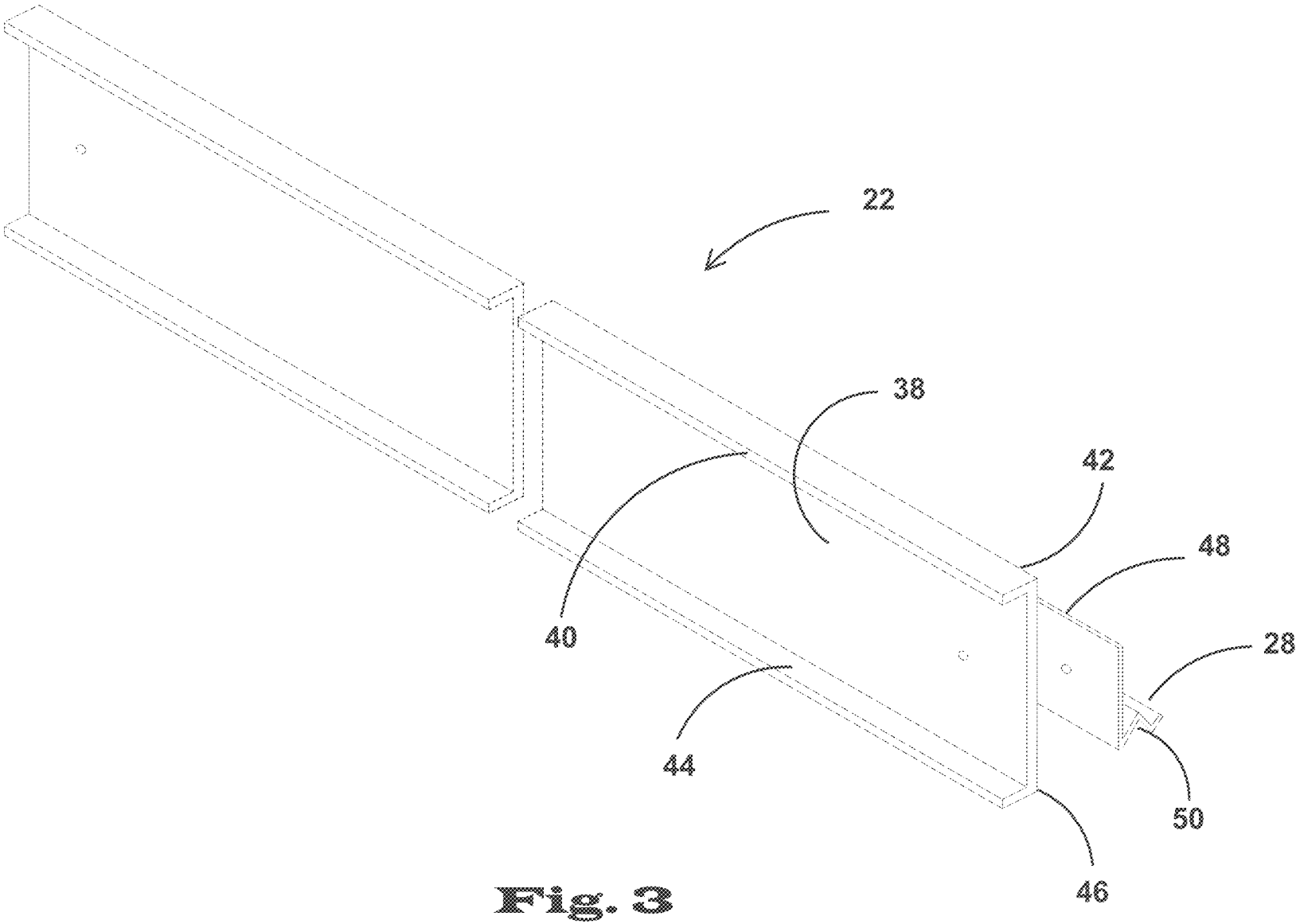
FIG. 3 is an isometric view of a display housing for use with the rack display of FIG. 1.

Turning now to FIG. 3, the channel assembly 22 is shown in greater detail. The support channel 26 of the channel assembly 22 comprises an elongated rectangular back plate 38. A top edge rail 40 extends from a top edge 42 of the back plate 38 and a bottom edge rail 44 extends from a bottom edge 46 of the back plate. The mount bracket 28 comprises a longitudinal bar 48 and at least one bracket attachment 50 secured to the longitudinal bar. Preferably the bracket attachment 50 will extend along a length of the longitudinal bar 48. The longitudinal bar 48 is preferably secured to a back side of the back plate 38 using welding, rivets, screws, or other applicable connection. The mount bracket 28 serves to secure the channel assembly 22 to at least one cross member 18 of the rack 12.

With reference again to FIG. 2, the display assembly 24 is discussed in further detail. The display housing 30 comprises an elongate rear base wall 52, an upper channel guide 54, and a lower channel guide 56. Preferably, as previously discussed, the base wall 52 of the display housing 30 is sized to fit in the support channel 26, resting between the top edge rail 40 and the bottom edge rail 44 and abutting a front side of the back plate 38 of the support channel. The base wall 52 preferably comprises a plurality of graphic insert supports 58. More preferably the graphic insert supports 58 comprise a plurality of longitudinal tabs secured to the base wall 52.

The upper channel guide 54 extends from an upper edge 60 of the base wall 52, and the lower channel guide 56 extends from a bottom edge 62 of the base wall. Preferably, the upper channel guide 54 and the lower channel guide 56 define a plurality of continuous and opposing channels spanning a length of the base wall 52. The upper channel guide 54 defines a first upper channel 64 proximate the base wall 52 and a second upper channel 66 separated a predetermined distance from the first upper channel. The lower channel guide 56 defines a first lower channel 68 proximate the base wall 52 and a second lower channel 70 separated the predetermined distance from the first lower channel. The first upper channel 64 opposes the first lower channel 68. The second upper channel 66 opposes the second lower channel 70. Preferably, the predetermined distance will be approximately 1 inch.

Figure 4:
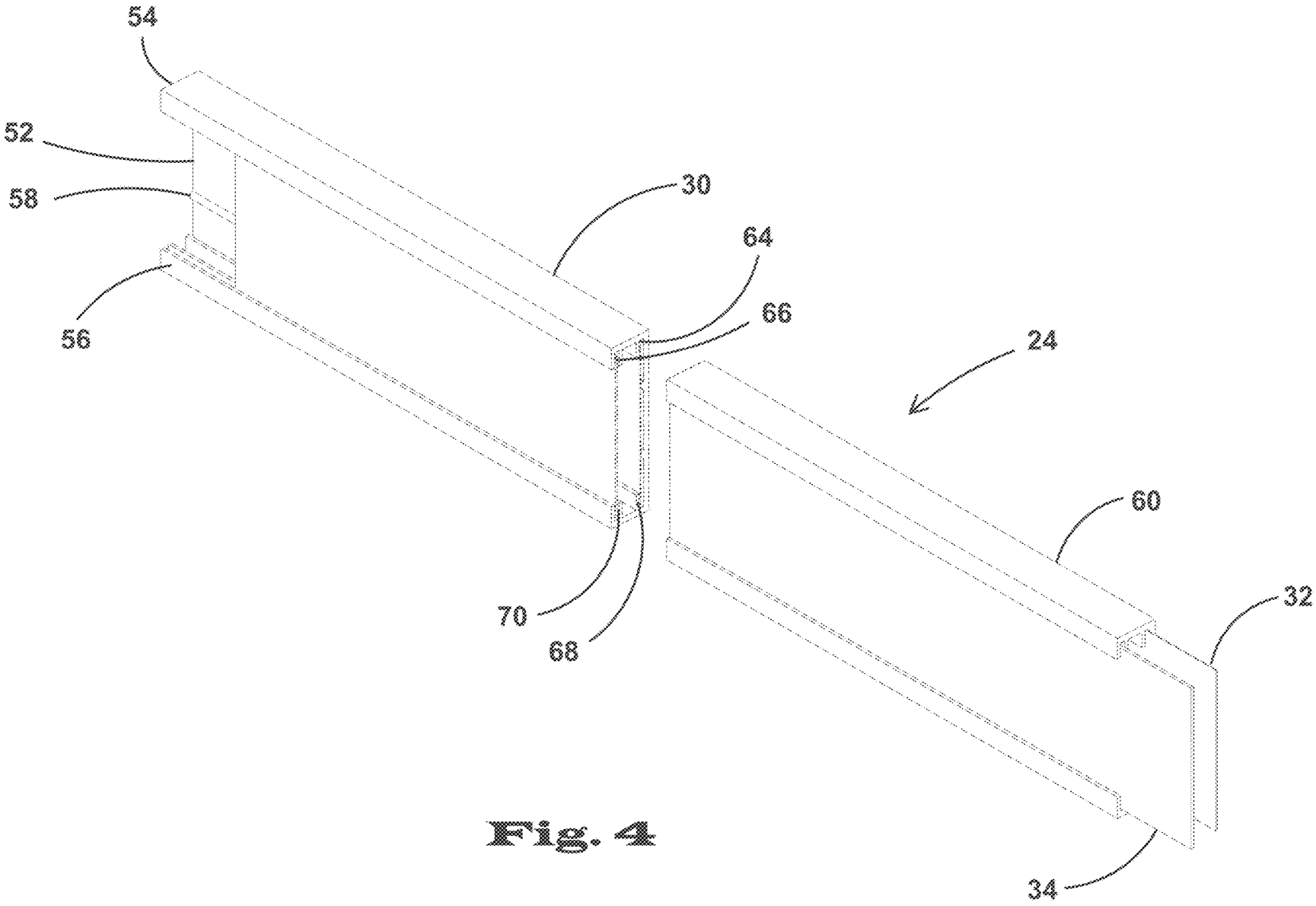
FIG. 4 is an assembled view of the display assembly of FIG. 2A.

Referring now to FIG. 4, the display assembly 24 is shown in assembled fashion. The graphic insert 32 comprises a material suitable for printing information related to the consumer products for display in the display system 10. Preferably, the graphic insert 32 comprises styrene. More preferably, the graphic insert 32 is sized to be inserted into the continuous slot defined by the first upper channel 64 and the opposing first lower channel 68. The transparent insert 34 comprises a material suitable to allow viewing through the insert. Preferably, the transparent insert 34 comprises acrylic. More preferably, the transparent insert 34 is sized to be inserted into the continuous slot defined by the second upper channel 66 and the opposing second lower channel 70. Most preferably, the transparent insert 34 may be imprinted with one or more images of a screening material, and similar to a screening material that may be displayed on the shelves of the rack 12. One skilled in the art will appreciate the transparent insert 34 with images of screening material allows the graphic insert 32 to be viewed as though seen through a screening product sold in the display system 10.

Various modifications can be made in the design and production of the present invention without departing from the spirit thereof. Thus, while the principal preferred construction and use of the invention have been explained in what is now considered to represent its best embodiments, it should be understood that the invention may be practiced otherwise than as specifically illustrated and described, and claimed in the following claims.

What is claimed is:

1. A display assembly comprising:

an elongate support channel having a back plate, a top rail extending from a top of the back plate, and a bottom rail extending from a bottom of the back plate;

at least one mount bracket secured to a back side of the back plate;

a display housing, the housing comprising:

an elongate base having a rear base wall, an upper channel guide extending from an upper edge of the base wall, and a lower channel guide extending from a lower edge of the base wall;

wherein the upper channel guide defines a first upper channel proximate the base wall and a second upper channel separated a predetermined distance from the first upper channel, each of the first and second upper channels spanning a length of the upper channel guide; and wherein the lower channel guide defines a first lower channel proximate the base wall and a second lower channel separated the predetermined distance from the lower channel, each of the first and second lower channels spanning a length of the lower channel guide; and wherein the first upper channel opposes the first lower channel; and wherein the second upper channel opposes the second lower channel;

a graphic insert adapted to be disposed in the first upper channel and the first lower channel; and a transparent insert adapted to be disposed in the second upper channel and the second lower channel;

wherein the display housing is adapted to be received by the support channel such that a back side of the base wall abuts a front side of the back plate.

2. The display assembly of claim 1 further comprising an adhesive secured to the front side of the channel wall such that the back side of the base wall contacts the adhesive when the display housing is received by the support channel.

3. The display assembly of claim 2 wherein the adhesive comprises two-sided tape.

4. The display assembly of claim 1 wherein the transparent insert comprises acrylic.

5. The display assembly of claim 4 wherein the transparent insert further comprises a printed graphic representative of screen material.

6. The display assembly of claim 4 wherein the transparent insert further comprises a plurality of printed graphics representative of a plurality of screen materials.

7. The display assembly of claim 1 wherein the graphic insert comprises styrene having printed graphics.

8. The display assembly of claim 1 further comprising:

a display rack comprising:

a plurality of upright supports;

at least one cross member connected between at least two of the plurality of upright supports;

at least one product shelf connected to the plurality of upright supports, the product shelf adapted to support at least one product for display;

wherein the at least one mount bracket is secured to the at least one cross member.

9. The display assembly of claim 1 wherein the rear base wall comprises a plurality of graphic insert supports.

10. The display assembly of claim 9 wherein the insert supports comprise a plurality of longitudinal tabs secured to the rear base wall.

11. A display system comprising:

a display rack comprising:

a plurality of upright supports;

at least one cross member connected between at least two of the plurality of upright supports;

at least one product shelf connected to the plurality of upright supports, the product shelf adapted to support at least one product for display;

a display assembly comprising:

an elongate support channel having a rear channel wall, a top rail extending from a top of the channel wall, and a bottom rail extending from a bottom of the channel wall;

at least one mount bracket secured to a back side of the channel wall, the at least one mount bracket adapted to be secured to the at least one cross member of the display rack;

a display housing, the housing comprising:

an elongate base having a rear base wall, an upper channel guide extending from an upper edge of the base wall, and a lower channel guide extending from a lower edge of the base wall;

wherein the upper channel guide defines a first upper channel proximate the base wall and a second upper channel separated a predetermined distance from the first upper channel, each of the first and second upper channels spanning a length of the upper channel guide; and wherein the lower channel guide defines a first lower channel proximate the base wall and a second lower channel separated the predetermined distance from the lower channel, each of the first and second lower channels spanning a length of the lower channel guide; and wherein the first upper channel opposes the first lower channel; and wherein the second upper channel opposes the second lower channel;

a graphic insert adapted to be disposed in the first upper channel and the first lower channel; and a transparent insert adapted to be disposed in the second upper channel and the second lower channel;

wherein the display housing is adapted to be received by the support channel such that a back side of the base wall abuts a front side of the channel wall.

* * * * *